US012704061B2

(12) United States Patent
Dumont et al.

(10) Patent No.: US 12,704,061 B2
(45) Date of Patent: Aug. 11, 2026

(54) DEPLOYMENT AND INTERPRETATION OF TRACER TECHNOLOGY USING DOWNHOLE EQUIPMENT

(71) Applicant: Schlumberger Technology Corporation, Sugar Land, TX (US)

(72) Inventors: Hadrien Dumont, Paris (FR); Morten Kristensen, Lysaker (NO); Adriaan Gisolf, Bucharest (RO); Francois-Xavier Dubost, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/004,879

(22) Filed: Dec. 30, 2024

(65) Prior Publication Data

US 2026/0185443 A1 Jul. 2, 2026

(51) Int. Cl.
*E21B 43/34* (2006.01)
*E21B 47/11* (2012.01)
*E21B 49/08* (2006.01)

(52) U.S. Cl.
CPC ..... *E21B 47/11* (2020.05); *E21B 49/0875* (2020.05)

(58) Field of Classification Search
CPC ..... E21B 43/34; E21B 43/16; C09K 8/34
USPC ..... 166/250.12
See application file for complete search history.

(56) References Cited

U.S. PATENT DOCUMENTS

| | | | | |
|---|---|---|---|---|
| 9,845,673 | B2 * | 12/2017 | Gisolf | E21B 49/08 |
| 10,626,721 | B2 | 4/2020 | Gisolf | |
| 11,280,188 | B2 | 3/2022 | Gisolf | |
| 11,649,724 | B2 * | 5/2023 | Elhawary | E21B 47/06 166/250.07 |
| 11,674,372 | B2 * | 6/2023 | Dumont | E21B 49/087 166/250.01 |
| 12,134,949 | B2 | 11/2024 | Dubost | |
| 2017/0198200 | A1 | 7/2017 | Sayfritz | |
| 2018/0171788 | A1 * | 6/2018 | Waid | E21B 49/088 |
| 2022/0243588 | A1 * | 8/2022 | Hudson | E21B 49/008 |
| 2024/0209728 | A1 | 6/2024 | Dubost | |
| 2024/0295153 | A1 | 9/2024 | Dumont | |
| 2025/0059847 | A1 | 2/2025 | Dubost | |

FOREIGN PATENT DOCUMENTS

WO 2025166203 A1 8/2025

* cited by examiner

*Primary Examiner* — William D Hutton, Jr.
*Assistant Examiner* — Ashish K Varma
(74) *Attorney, Agent, or Firm* — Kyle R. Miiller

(57) ABSTRACT

Embodiments presented provide for a method and apparatus for downhole tracer technology. In specific embodiments, different tracers may be placed into an injection well and amounts of residual carbon dioxide saturation may be determined.

16 Claims, 5 Drawing Sheets

DEPLOYMENT AND INTERPRETATION OF TRACER TECHNOLOGY USING DOWNHOLE EQUIPMENT

CROSS-REFERENCE TO RELATED APPLICATIONS

None

FIELD OF THE DISCLOSURE

Aspects of the disclosure relate to tracer technology. More specifically, aspects of the disclosure relate to using a formation testing apparatus to inject and interpret tracers placed within geological stratum.

BACKGROUND

Tracer injections into geological stratum are a sophisticated technique used to analyze subsurface formations. The process begins with the selection of appropriate tracers, which are chemical substances designed to track the movement of fluids through the geological formations. These tracers are chosen based on their chemical stability, detectability, and compatibility with the geological environment. Once selected, the tracers are prepared in precise concentrations to ensure accurate tracing results.

The next step involves the utilization of a formation testing apparatus, which is inserted into the borehole to the desired depth within the geological stratum. The apparatus is equipped with injection systems that allow for the controlled release of the tracers into the formation. This step requires careful calibration to ensure that the tracers are evenly distributed and that their movement can be effectively monitored. The apparatus is also designed to withstand the high pressures and temperatures often found in subsurface environments.

Once the tracers are injected, they begin to migrate through the geological stratum following the natural flow of fluids. Monitoring equipment is then employed to track the movement of the tracers. This monitoring typically involves sampling the fluid at various points within the formation and analyzing the concentration of tracers present. Data collected from these samples provide valuable insights into the permeability, porosity, and fluid flow characteristics of the geological formation.

Despite its effectiveness, conventional tracer injection technology has several significant drawbacks. One of the primary issues is the relatively high economic cost associated with the process. The cost includes not only the tracers themselves but also the specialized equipment required for their injection and monitoring. Furthermore, the need for highly trained personnel to operate this equipment adds to the overall expense, making it a costly endeavor for many operations.

Another notable drawback is the inability to distinguish between different tracers within the geological stratum. This limitation can lead to inaccurate or incomplete data, which in turn affects the reliability of the analysis. Additionally, the use of specialized injection equipment poses challenges in terms of accessibility and operational complexity. These factors can hinder the efficiency of the tracer injection process, making it less practical for widespread use in various geological studies.

There is a need to provide an apparatus and methods that are easier to operate than conventional apparatus and methods for tracer operations.

There is a further need to provide apparatus and methods that do not have the drawbacks discussed above.

There is a still further need to reduce economic costs associated with operations and apparatus described above with conventional tools and methods for tracer injections into geological formations.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method for deployment and interpretation of tracers in a geological formation is disclosed. The method may comprise conveying a downhole testing apparatus to a desired elevation within a wellbore. The method may also comprise setting a dual-packer arrangement, defining a position to evaluate next to the wellbore. The method may also comprise pumping mud from an interval defined by the dual-packer arrangement. The method may also comprise injecting at least one tracer carried by a volume sampling chamber of the downhole testing apparatus into the formation. The method may also comprise circulating a fluid other than mud to a bottom of the drill pipe. The method may also comprise injecting the fluid other than mud into the interval. The method may also comprise deflating the dual-packer arrangement.

In another example embodiment, a method for deployment and interpretation of tracers in a geological formation is disclosed. The method may comprise conveying a downhole testing apparatus to a desired elevation within a wellbore. The method may further comprise setting a dual-packer arrangement, defining a position to evaluate next to the wellbore. The method may further comprise pumping mud from an interval defined by the dual-packer arrangement. The method may further comprise removing mud from a drill pipe using a circulating sub. The method may further comprise closing the circulating sub. The method may further comprise performing a flow test of a fluid into the drill pipe. The method may further comprise injecting drill pipe formation water back into the interval. The method may further comprise injecting at least one tracer carried by a volume sampling chamber of the downhole testing apparatus into the formation. The method may further comprise conducting a test of formation fluids with the downhole testing apparatus.

In another embodiment, an article of manufacture configured to be read and executed by a computing apparatus is disclosed. The article of manufacture may be configured to contain a list of instructions for controlling equipment at a wellsite, the list of instructions containing, at least in part, a method for deployment and interpretation of tracers in a geological formation, comprising conveying a downhole testing apparatus to a desired elevation within a wellbore. The method may further comprise setting a dual-packer arrangement, defining a position to evaluate next to the wellbore. The method may further comprise pumping mud from an interval defined by the dual-packer arrangement.

The method may further comprise removing mud from a drill pipe. The method may further comprise performing a flow test of a fluid into the drill pipe. The method may further comprise injecting at least one tracer carried by a volume sampling chamber of the downhole testing apparatus into the formation. The method may further comprise circulating carbon dioxide to a bottom of the drill pipe. The method may further comprise injecting the carbon dioxide into the interval. The method may further comprise measuring fall off of carbon dioxide injected into the interval. The method may further comprise pumping water into the wellbore. The method may further comprise deflating the dual-packer arrangement. The method may further comprise conducting a test of formation fluids with the downhole testing apparatus.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are, therefore, not to be considered limiting of its scope, for the disclosure may admit to other equally effective embodiments.

Figure 1:
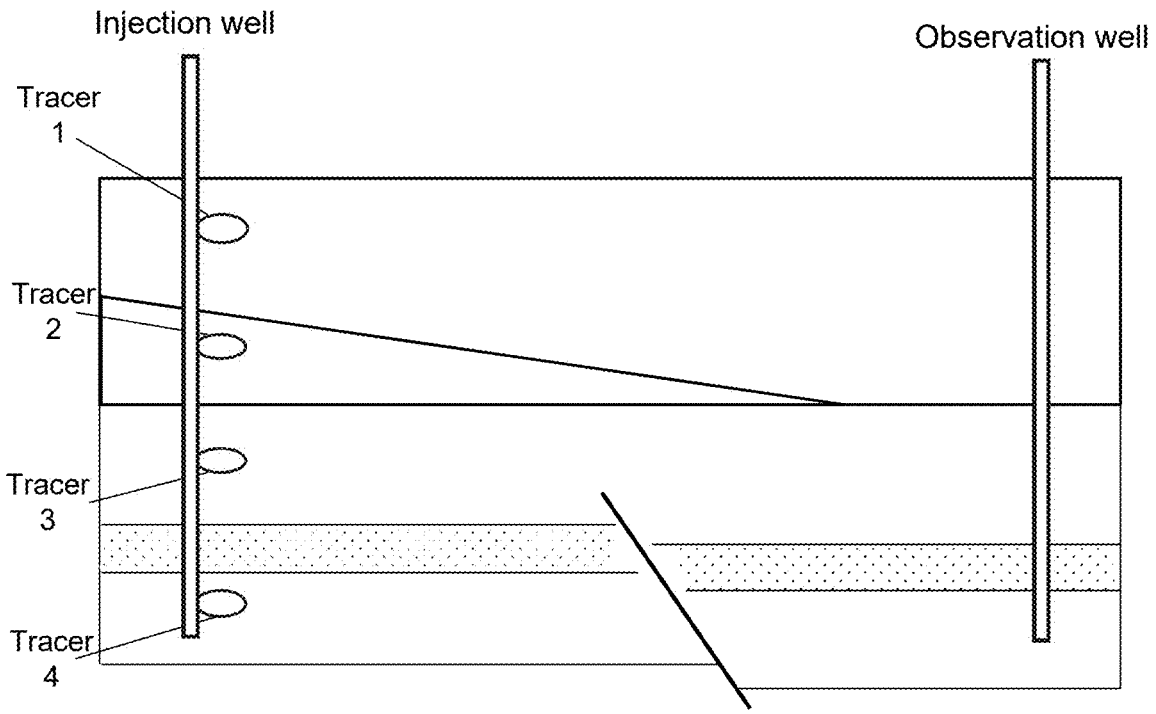
FIG. 1 is a four-part tracer test being placed into an injection well with associated geological stratum and observation well.

To facilitate understanding, identical reference numerals have been used, where possible, to designate identical elements that are common to the figures ("FIGS"). It is contemplated that elements disclosed in one embodiment may be beneficially utilized in other embodiments without specific recitation.

DETAILED DESCRIPTION

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer, or section. Terms such as "first", "second", and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When an element or layer is referred to as being "on", "engaged to", "connected to", or "coupled to" another element or layer, it may be directly on, engaged, connected, or coupled to the other element or layer, or interleaving elements or layers may be present. In contrast, when an element is referred to as being "directly on", "directly engaged to", "directly connected to", or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood; however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure provide for injection operations for geological stratum. The injections may be performed through operational procedures described. In embodiments, the injections may be performed in cased hole systems. Other possibilities exist as to performing injections in open hole systems. As will be understood, when injections occur in cased hole systems, intervals of penetrations may be provided.

In embodiments, a downhole formation testing apparatus is placed into a wellbore and lowered to a specific testing position within a reservoir and depth. The downhole formation testing apparatus is then placed into a mode where injection of fluids may occur. The fluids injected may be carried by the downhole formation testing apparatus itself or the fluids may be pumped to the downhole formation testing apparatus from a remote location, for example, an uphole location. As will be understood, the fluids may incorporate different materials, such as tracers. After the injection, the tracers may be analyzed. Such analysis can be performed, in one example embodiment, using a standard sampling technique, by sampling fluid at an adjacent well or different well and then analyzing the retained fluids in a laboratory. In other embodiments, a downhole fluid testing apparatus within the wellbore may also be used. Testing may occur at different depths to identify the presence of tracers in the sampled formation fluids.

Figure 2:
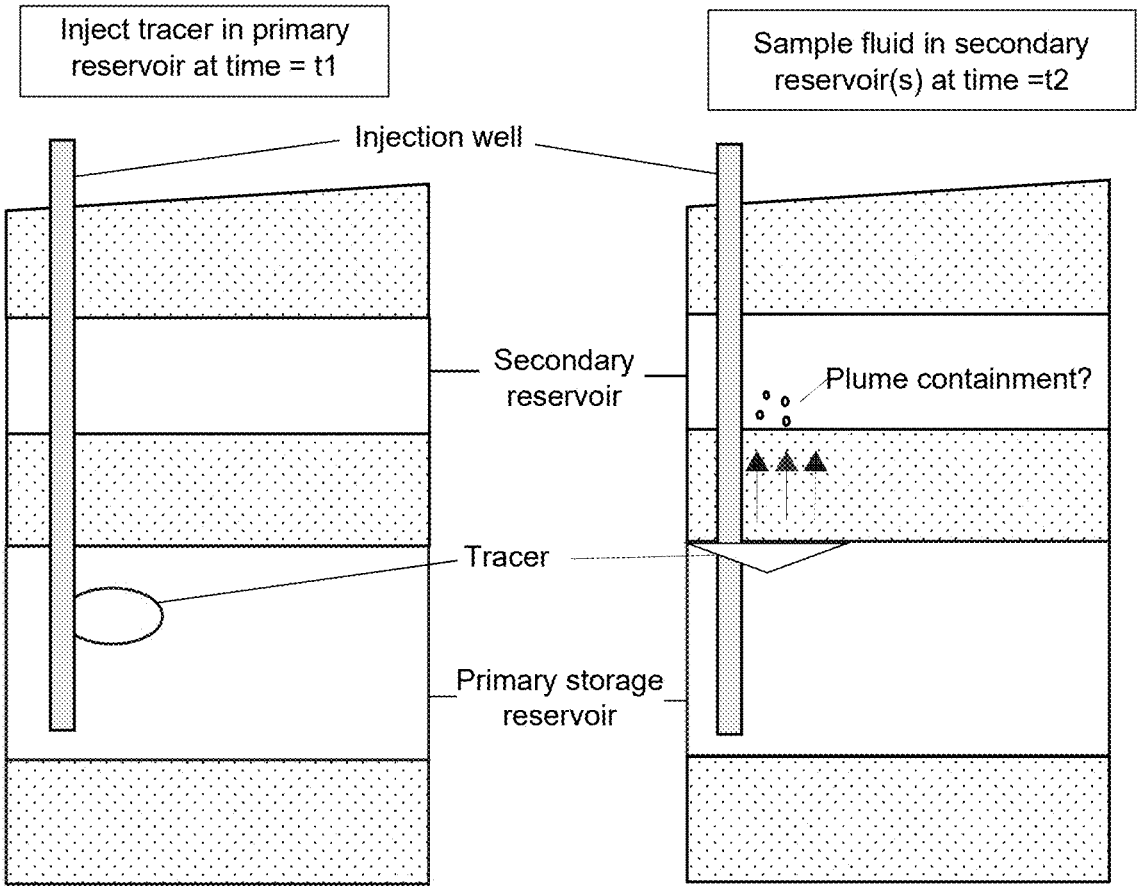
FIG. 2 is an illustration of a tracer test with access to vertical and lateral connectivity and possible carbon dioxide migration through the storage reservoir seal in accordance with one example embodiment of the disclosure.
Figure 3:
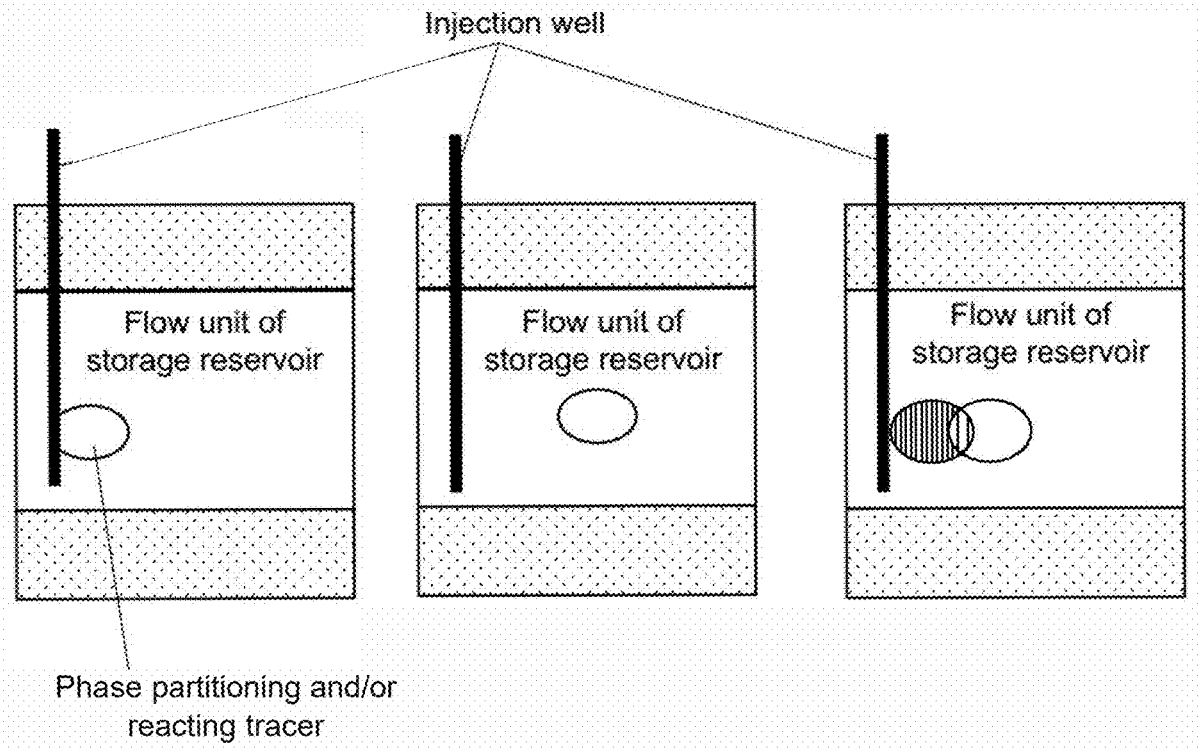
FIG. 3 is an example of a downhole apparatus test to assess residual carbon dioxide saturation to brine.

Referring to FIG. 1, an illustration of a conventional downhole tracer test is illustrated. During drilling of a carbon dioxide injection well, a downhole sampling apparatus may be used to inject different tracers into the geological stratum. These tracers may be used to obtain valuable geological stratum properties. Identification of the tracers may be accomplished from different points. In one example embodiment, recovery may be performed at the injection well. In other possibilities, an observation well may be used. The observation well may be specifically constructed for sampling of the tracers and fluids. As will be understood, the presence or absence of different tracers will indicate fluid flow potential for the stratum. Tracer concentrations can be tracked and identified. Referring to FIG. 2, an illustration of a downhole fluid analyzer tracer test is shown to assess vertical connectivity and possible carbon dioxide migration through the reservoir. In this non-limiting embodiment, a tracer or tracers are placed in the stratum below an area with an assumed seal. As defined, the seal is the encapsulation of a geological stratum within a boundary. Indications of leakage may be obtained by performing a sampling above the seal. As will be understood, different types of fluids may be used, including gases and liquids. Tracers may also incorporate radioactive materials, where necessary. Referring to FIG. 3, a cross-sectional timeline view of the geological stratum undergoing a test is illustrated. Specifically, this test may be used to assess residual carbon dioxide saturation to brine. At the left, an injection well is placed into a geological stratum that requires testing. This geological stratum may have trapped hydrocarbons, such as oil and/or natural gas. In other embodiments, the geological stratum may be devoid of hydrocarbons and may be a desired area for storage of gas, such as carbon dioxide. At the start of the test, a tracer is injected into the stratum as illustrated by the oval. The illustration of the injection as an oval is merely for appearance and the injection may take a more complex path. The concentration and volumes of tracers injected may be recorded downhole and/or transmitted to an uphole environment. The tracer may be a partitioning and reacting tracer within a specified "target zone" of a storage reservoir. In embodiments, the storage reservoir may have been previously prepared for such tests. In these embodiments, the storage reservoir may have been previously flooded with carbon dioxide. Injection of carbon dioxide may have been initiated from on-board storage from a downhole testing apparatus. In embodiments, the formation may have been further prepared by being flushed with formation water to drive the carbon dioxide, that was previously flooded into the stratum/reservoir, down to residual levels. During this time, phase partitioning may occur as the tracers and other fluids interact with the stratum and stratum fluids. In embodiments, when chemical tracers are used, an elapsed time may be achieved before proceeding with further method steps. In the middle portion of FIG. 3, the flow unit (oval) is pushed into the formation. This may occur through additional pumping of fluids at the injection well through a downhole fluid testing apparatus. A waiting period may be conducted at this point. Different waiting periods may be performed, between 1 hour and 8 hours, as a non-limiting example. At the right side of FIG. 3, the downhole fluid testing apparatus is used to retrieve the tracers and other fluids placed in the downhole fluid testing system. The downhole fluid testing system may then be recovered and the fluids analyzed. As will be understood, the downhole fluid testing system may also be equipped to perform the analysis downhole.

Figure 4:
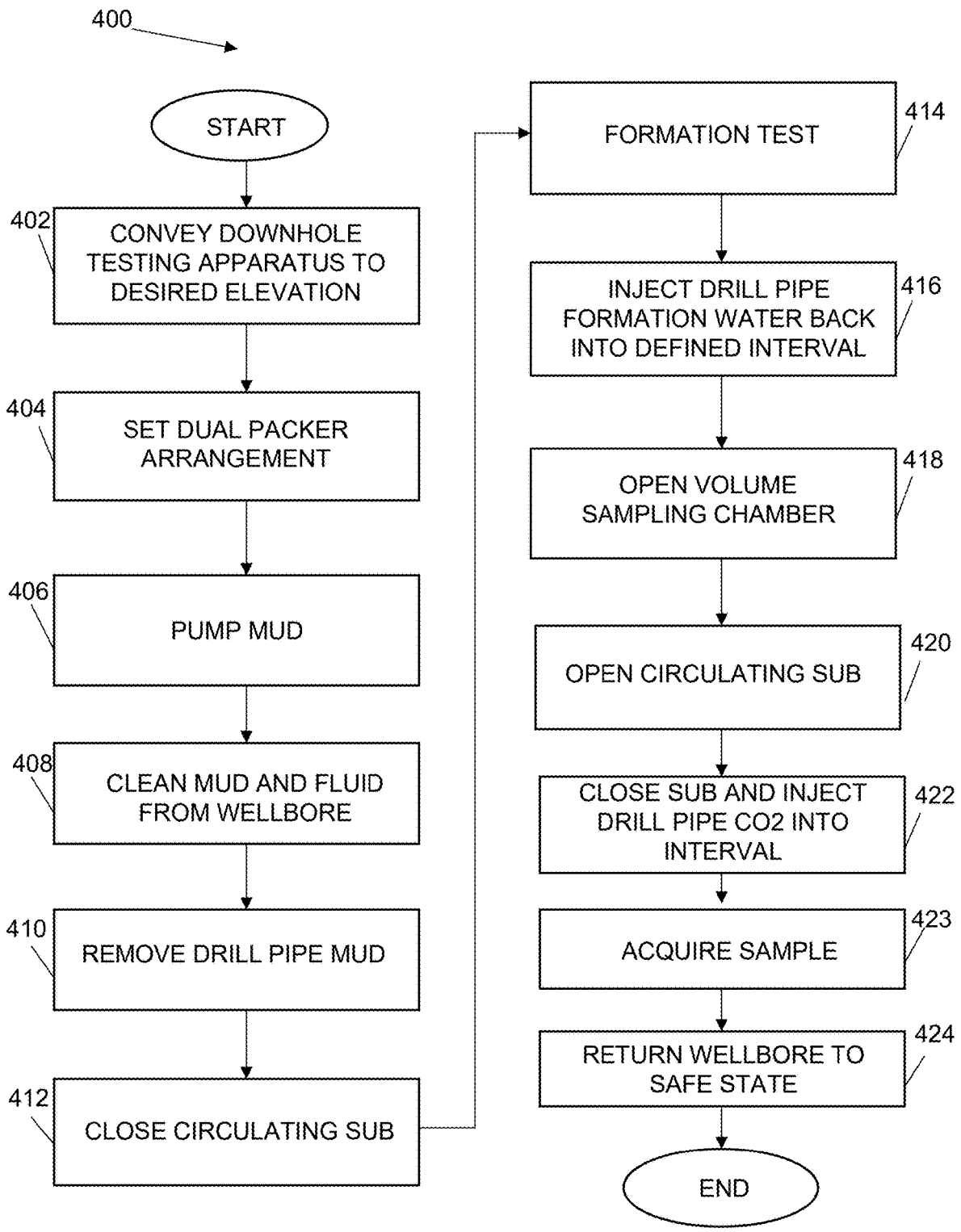
FIG. 4 is a method of deployment and interpretation of tracer technology using downhole equipment in one example embodiment of the disclosure.

Referring to FIG. 4, a method in accordance with one example embodiment of the disclosure is illustrated. The method 400, may comprise, at 402, conveying a downhole testing apparatus to a desired elevation. In embodiments, the conveyance may be by drill pipe. In other embodiments, the conveyance can be by wireline. Once at the desired depth, powerup procedures, tool checks, cable clamping and wellbore correlations may commence. Verification of depth may also occur as well as performing checks of the apparatus to make sure the apparatus is in working order.

The method may proceed, at 404, with setting a dual-packer arrangement, defining a position to evaluate next to the wellbore. Pretesting of the dual-packer arrangement may occur. Other activities may occur, such as setting necessary slip joints. The method may proceed, at 406, with pumping mud from the interval defined by the dual-packer arrangement set at 404. The pumped mud may be placed to the annulus of the wellbore. At 408, any interval mud and/or invaded fluid may be cleaned from the wellbore. At 410, the method may proceed with removing drill pipe mud. In this step, clean fluid may be circulated within the drill pipe. The fluid used may have a lower density than formation water. During this step, a circulating sub may be used wherein the sub is opened and fluid is returned to the surface. In some embodiments, flow from the interval may also be returned at the same time. At 412, the circulating sub, which may have been opened at 410, may be closed. At 414, a flow test of formation water may occur into the drill pipe. Some values for this step may be, for example, 200 barrels for a 5 inch inner diameter drill pipe at 3000 meters long. The formation water may be pumped using a downhole testing apparatus into the drill pipe. This may be performed in a balanced or underbalanced drill pipe state. In some embodiments, natural flow may cause water to flow into an underbalanced drillpipe. Water samples may be captured during these activities. A pressure build up may be recorded. At 416, the method may continue with injecting drill pipe formation water back into the defined interval. In this step, pumping may occur from the surface and fall-off may be measured. In embodiments, injection may occur from a downhole apparatus, such as a downhole formation testing apparatus, followed by pumping from a surface location.

The method may continue, at 418, with opening a volume sampling chamber that is filled with tracer fluids. Hydrostatic pressure and/or the downhole testing apparatus may be used to push the tracer from the volume sampling chamber into the formation. At 420, the method may continue with opening the circulating sub and circulating carbon dioxide to a bottom of the drill pipe. This step may include choking back on the surface return to prevent carbon dioxide flashing. Also, during this step, drill pipe fluid may be circulated into the annulus or injected into the formation using the downhole formation tester pumps. Surface pressure may be maintained at a drill pipe choke line, in some embodiments.

The method may continue, at 422, with closing the circulating sub and injecting drill pipe carbon dioxide into the interval. During this step, the injection may originate with the downhole testing apparatus followed with pumping from the surface. Falloff may be measured during this step. At 423, the method may optionally use the formation testing device to acquire a sample of carbon dioxide with tracers from the formation.

The method may continue, at 424, with return of the wellbore to a state that is suitable for ending station operations and packer deflation. In this step, carbon dioxide is displaced in the drill pipe with fresh water from the surface and as much carbon dioxide as possible is injected into the formation. This prevents recirculation of carbon dioxide back to the surface. Mud may be circulated into the formation and/or the annulus, as required. Deflation of the dual packer may occur and circulation performed within the wellbore, the formation, or annulus. The fluid used may be fresh water. In some instances, formation fluid may be sampled using the downhole testing apparatus. Such actions may occur prior to deflation of the dual packer. In some instances, after deflation, bullheading, defined by forcing fluids back into the formation, may occur.

Figure 5:
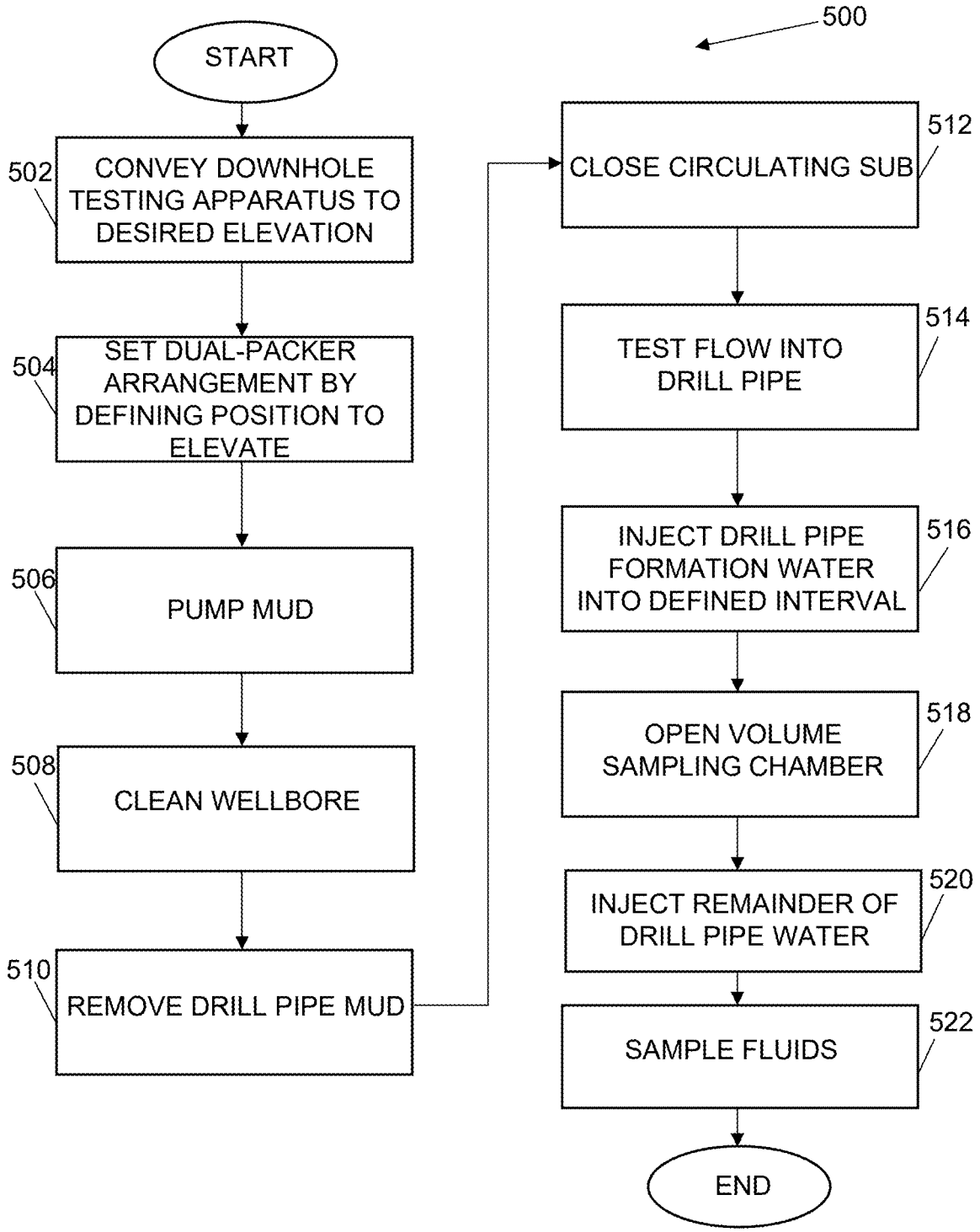
FIG. 5 is a second method of deployment and interpretation of tracer technology using downhole equipment in a second embodiment of the disclosure.

Referring to FIG. 5, a method in accordance with one example embodiment of the disclosure is illustrated. The method 500, may comprise, at 502, conveying a downhole testing apparatus to a desired elevation. In embodiments, the conveyance may be by drill pipe. In other embodiments, the conveyance can be by wireline. Once at the desired depth, powerup procedures for the apparatus may commence. Verification of depth may also occur as well as performing checks of the apparatus to make sure the apparatus is in working order.

The method may proceed, at 504, with setting a dual-packer arrangement, defining a position to evaluate next to the wellbore. Pretesting of the dual-packer arrangement may occur. Other activities may occur, such as setting necessary slip joints.

The method may proceed, at 506, with pumping mud from the interval defined by the dual-packer arrangement set at 504. The pumped mud may be placed to the annulus of the wellbore. At 508, any interval mud and/or invaded fluid may be cleaned from the wellbore.

At 510, the method may proceed with removing drill pipe mud. In this step, clean fluid may be circulated within the drill pipe. The fluid used may have a lower density than formation water. During this step, a circulating sub may be used wherein the sub is opened and fluid is returned to the surface. In some embodiments, flow from the interval may also be returned at the same time. At 512, the circulating sub may be closed.

At 514, a flow test of formation water may occur into the drill pipe. Some values for this step may be, for example, 200 barrels for a 5 inch inner diameter drill pipe 3000 meters long. The formation water may be pumped using a downhole testing apparatus into the drill pipe. This may be performed in a balanced or underbalanced drill pipe state. Water samples may be captured during these activities. At 516, the method may continue with injecting some drill pipe formation water back into the defined interval. In this step, pumping may occur from either the downhole pumps or from the surface and fall-off may be measured. In embodiments, not all drill pipe formation water is used for the injection.

The method may continue, at 518, with opening a volume sampling chamber that is filled with tracer fluids. Hydrostatic pressure and/or the downhole testing apparatus may be used to push the tracer into the formation. At 520, the method may continue with injecting a remainder of drill pipe water into the formation. At 522, fluids may be sampled. Deflation of the dual packer may occur, and circulation performed within the wellbore. In some instances, formation fluid may be sampled using the downhole testing apparatus. Such actions may occur prior to deflation of the dual packer. As will be understood, alterations to the method 500 are possible wherein some steps may be skipped or omitted.

Interpretation of Results

In this section, we discuss preferred applications of the disclosure in terms of valuable insights that can be extracted by practicing the methods as outlined above. It is noted that the results are not limited to the applications discussed.

Lateral and Vertical Connectivity

Lateral and vertical reservoir connectivity is a major concern in both carbon capture and storage applications as well as oil and gas recovery projects. In carbon capture and storage projects, understanding lateral connectivity has important implications for carbon dioxide plume movement and accessible storage volume. FIG. 1 shows one aspect of the disclosure addressing lateral connectivity. During drilling of a carbon dioxide injection well (or a water injection well for conventional oil and gas), a downhole testing apparatus is used to place different tracers within distinct flow units of the host rock. Upon later fluid sampling (surface or downhole) in an observation well, the presence or absence of different tracers will indicate connectivity for the respective flow units. Moreover, measured tracer concentration versus time can be used to infer zonal properties and flow contributions.

Referring to FIG. 2, a similar application to that of FIG. 1 is illustrated addressing vertical connectivity. In this example embodiment, vertical connectivity is illustrated through an assumed seal. This may be useful in the delineation of a carbon dioxide storage reservoir. In this embodiment, a tracer or tracers that are placed below the seal using a downhole testing apparatus may rise up through the seal and be later identified. This may be achieved by later sampling from overlying, secondary reservoirs that can reveal possible leakage of carbon dioxide through the assumed seal. Such parameters are useful in qualifying a reservoir as adequate for storage and are useful in endeavors where carbon capture technologies gather greenhouse gasses and need a storage reservoir.

In a different embodiment of the vertical connectivity concept outlined in FIG. 2, multiple tracers may be placed within different flow units of the host rock. Rather than sampling fluid from overlying formations, detectors (capable of detecting tracer presence) are placed in shallow soil wells (depth of meters to tens of meters). The arrival of a tracer in the shallow wells then indicates a leakage path between the flow unit, where the tracer was placed, and the surface.

In-Situ Carbon Dioxide-Brine Relative Permeability and Residual Carbon Dioxide Saturation Residual trapping of carbon dioxide is an important storage mechanism in carbon dioxide storage projects and often the dominant contributor to overall carbon dioxide storage. Therefore, characterization of residual carbon dioxide saturation is important for the design of storage projects. The residual saturation will generally vary across different rock types, so the ability with a downhole testing apparatus to conduct targeted, zonal tests is a benefit.

In oil and gas wells, the concept of characterizing residual oil saturation to water using chemical tracers is well known. So-called Single-Well Chemical Tracer Tests (SWCTTs) are routinely performed to assess residual oil saturation. These tests involve the injection (usually from surface) of a tracer that partitions between the water and oil phases. Within the water phase, the tracer undergoes a hydrolysis reaction to form a product tracer. After a suitable soaking time to allow time for this reaction, the well is produced, and the concentrations of un-reacted and product tracers are measured over time. The residual oil saturation is then estimated from the difference between these two concentration profiles. In embodiments, a biodegradable tracer may be used to eliminate the potential for contamination of the environment and/or any recovered hydrocarbons.

Aspects of the disclosure use a downhole formation testing apparatus to conduct the tracer test downhole and in targeted reservoir zones. As previously described, FIG. 3 illustrates the concept of a tracer test to assess residual saturation (in one embodiment, the residual carbon dioxide saturation to brine). First, the downhole testing apparatus is used to place a partitioning and reacting tracer within a target zone of the storage reservoir which has previously been flooded with carbon dioxide (for example, during an injection test with a downhole testing apparatus) and subsequently flushed with formation water to drive the carbon dioxide saturation down to residual levels. In an alternative embodiment; however, the zone is produced using a downhole testing apparatus until no more free-phase carbon dioxide is flowing, thereby leaving the formation around the injection/production interval with only residual carbon dioxide. As the tracer is injected together with formation water, the fluids will partition into the residual carbon dioxide phase. The part of the tracer remaining in the brine phase undergoes reaction to form a product tracer. After a suitable soaking period, the tracers (both un-reacted and product tracers) are produced back into the formation testing tool and samples are collected in bottles for analysis at the surface, thus resulting in measurements of tracer concentration versus time from which the residual carbon dioxide saturation can be interpreted. In different embodiments, the tracers would be detectable using downhole fluid analysis sensors within the downhole testing apparatus, thus providing continuous measurements of tracer concentration versus time, rather than capturing discrete samples for surface analysis.

In a variation of the above method for residual carbon dioxide saturation determination, a series of different partitioning tracers may be injected into a reservoir zone containing both carbon dioxide and brine as mobile phases. In embodiments, the tracer injection is spaced out in time so that a portion of one tracer is injected first, followed by a second tracer, and so on. Upon producing back the mixture of carbon dioxide and brine, concentration versus time profiles for each tracer are measured (either by capturing discrete samples for surface analysis, or through characterization using downhole fluid analysis sensors-whichever method is feasible and preferred). The tracer concentration profiles carry information about the relative movement of the carbon dioxide and brine phases and can, thus, be used to interpret carbon dioxide-brine relative permeability-another parameter for design of carbon dioxide storage projects.

Quantitative analysis may be used, as one non-limiting possibility, for interpretation of tests. When fluid is recovered at an observation well or by the downhole fluid apparatus, mean residence times for the tracers may be identified. Existing field conditions may be estimated and modeled, or a simple steady-state flow may be assumed. Knowing the fraction of tracer mass recovered at a specified extraction well, a pore volume swept by the tracer may be calculated. Similar analysis may be achieved for two phase or partitioning tracers, where used, in that swept pore volumes may be calculated based upon mean residence times. Amounts of tracers may be identified by chemical or separation analysis performed by a downhole tester or at a laboratory.

Example embodiments of the claims are presented. The recitation of these features should not be considered limiting. In one example embodiment, a method for deployment and interpretation of tracers in a geological formation is disclosed. The method may comprise conveying a downhole testing apparatus to a desired elevation within a wellbore. The method may also comprise setting a dual-packer arrangement, defining a position to evaluate next to the wellbore. The method may also comprise pumping mud from an interval defined by the dual-packer arrangement. The method may also comprise injecting at least one tracer carried by a volume sampling chamber of the downhole testing apparatus into the formation. The method may also comprise circulating a fluid other than mud to a bottom of the drill pipe. The method may also comprise injecting the fluid other than mud into the interval. The method may also comprise deflating the dual-packer arrangement.

In another example embodiment, the method may be performed wherein the conveying of the downhole testing apparatus is by drill pipe.

In another example embodiment, the method may be performed wherein the conveying of the downhole testing apparatus is by wireline.

In another example embodiment, the method may further comprise performing at least one powerup sequence for the downhole testing apparatus after the conveying of the downhole testing apparatus to the desired elevation.

In another example embodiment, the method may further comprise verifying the elevation of the downhole testing apparatus after the performing of the at least one powerup sequence.

In another example embodiment, the method may further comprise performing a pretest of the dual packer arrangement after the setting of the dual packer arrangement.

In another example embodiment, the method may be performed wherein the pumping mud from the interval is placed in an annulus of the wellbore.

In another example embodiment, the method may be performed wherein the removal of the mud from the drill pipe includes circulating a clean fluid within the drill pipe.

In another example embodiment, the method may be performed wherein the clean fluid is one of water and a fluid with a density lower than a density of formation fluid.

In another example embodiment, the method may be performed wherein a downhole circulating sub is used to convey the clean fluid.

In another example embodiment, the method may be performed wherein the clean fluid is pumped from a surface elevation.

In another example embodiment, the method may be performed wherein drill pipe fluid is also injected into the formation when the carbon dioxide is injected.

In another example embodiment, a method for deployment and interpretation of tracers in a geological formation is disclosed. The method may comprise conveying a downhole testing apparatus to a desired elevation within a wellbore. The method may further comprise setting a dual-packer arrangement, defining a position to evaluate next to the wellbore. The method may further comprise pumping mud from an interval defined by the dual-packer arrangement. The method may further comprise removing mud from a drill pipe using a circulating sub. The method may further comprise closing the circulating sub. The method may further comprise performing a flow test of a fluid into the drill pipe. The method may further comprise injecting drill pipe formation water back into the interval. The method may further comprise injecting at least one tracer carried by a volume sampling chamber of the downhole testing apparatus into the formation. The method may further comprise conducting a test of formation fluids with the downhole testing apparatus.

In another example embodiment, the method may be performed wherein the circulating sub is used to remove mud from the drill pipe wherein a fluid is used to displace formation water, wherein the fluid used has a lower density than the formation water.

In another example embodiment, the method may be performed wherein the flow test is performed in one of a balanced and an underbalanced well state.

In another example embodiment, the method may further comprise deflating the dual-packer arrangement.

In another example embodiment, the method may further comprise moving to a second desired elevation within the wellbore.

In another example embodiment, the method may be performed wherein the tracer is a single well chemical tracer.

In another example embodiment, the method may be performed wherein the tracer includes a biodegradable formulation.

In another embodiment, an article of manufacture configured to be read and executed by a computing apparatus is disclosed. The article of manufacture may be configured to contain a list of instructions for controlling equipment at a wellsite, the list of instructions containing, at least in part, a method for deployment and interpretation of tracers in a geological formation, comprising conveying a downhole testing apparatus to a desired elevation within a wellbore. The method may further comprise setting a dual-packer arrangement, defining a position to evaluate next to the wellbore. The method may further comprise pumping mud from an interval defined by the dual-packer arrangement. The method may further comprise removing mud from a drill pipe. The method may further comprise performing a flow test of a fluid into the drill pipe. The method may further comprise injecting at least one tracer carried by a volume sampling chamber of the downhole testing apparatus into the formation. The method may further comprise circulating carbon dioxide to a bottom of the drill pipe. The method may further comprise injecting the carbon dioxide into the interval. The method may further comprise measuring fall off of carbon dioxide injected into the interval. The method may further comprise pumping water into the wellbore. The method may further comprise deflating the dual-packer arrangement. The method may further comprise conducting a test of formation fluids with the downhole testing apparatus.

In another example embodiment, the article of manufacture may be configured in a form of one of a compact disk, a solid-state drive, a computer hard disk, and a universal serial bus device.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method for deployment and interpretation of tracers in a geological formation, comprising:

conveying a downhole testing apparatus to a desired elevation within a wellbore;

setting a dual-packer arrangement, defining a position to evaluate next to the wellbore;

pumping mud from an interval defined by the dual-packer arrangement;

injecting carbon dioxide into the interval defined by the dual-packer arrangement;

injecting at least one tracer carried by a volume sampling chamber of the downhole testing apparatus into the formation;

interpreting residual carbon dioxide saturation by measuring a concentration of the at least one tracer versus time;

circulating a fluid other than mud to a bottom of a drill pipe;

injecting the fluid other than mud into the interval; and deflating the dual-packer arrangement.

2. The method according to claim 1, wherein the conveying of the downhole testing apparatus is by the drill pipe.

3. The method according to claim 1, wherein the conveying of the downhole testing apparatus is by wireline.

4. The method according to claim 1, further comprising:

performing at least one powerup sequence for the downhole testing apparatus after the conveying of the downhole testing apparatus to the desired elevation.

5. The method according to claim 4, further comprising:

verifying the elevation of the downhole testing apparatus after the performing of the at least one powerup sequence.

6. The method according to claim 1, further comprising:

performing a pretest of the dual-packer arrangement after the setting of the dual-packer arrangement.

7. The method according to claim 1, wherein a downhole circulating sub is used to convey the fluid.

8. The method according to claim 1, wherein the fluid is pumped from a surface elevation.

9. The method according to claim 1, wherein drill pipe fluid is also injected into the formation.

10. A method for deployment and interpretation of tracers in a geological formation, comprising:

conveying a downhole testing apparatus to a desired elevation within a wellbore;

setting a dual-packer arrangement, defining a position to evaluate next to the wellbore;

pumping mud from an interval defined by the dual-packer arrangement;

injecting carbon dioxide into the interval defined by the dual-packer arrangement;

removing mud from a drill pipe using a circulating sub;

closing the circulating sub;

performing a flow test of a fluid into the drill pipe;

injecting drill pipe formation water back into the interval;

injecting at least one tracer carried by a volume sampling chamber of the downhole testing apparatus into the formation;

interpreting residual carbon dioxide saturation by measuring a concentration of the at least one tracer versus time; and conducting a test of formation fluids with the downhole testing apparatus.

11. The method according to claim 10, wherein the circulating sub is used to remove mud from the drill pipe, wherein a fluid is used to displace formation water, wherein the fluid used has a lower density than the formation water.

12. The method according to claim 10, wherein the flow test is performed in one of a balanced and an underbalanced well state.

13. The method according to claim 10, further comprising deflating the dual-packer arrangement.

14. The method according to claim 13, further comprising moving to a second desired elevation within the wellbore.

15. The method according to claim 10, wherein the tracer is a single well chemical tracer.

16. The method according to claim 10, wherein the tracer includes a biodegradable formulation.

* * * * *